US011824293B2

(12) United States Patent
Yang et al.

(10) Patent No.: US 11,824,293 B2
(45) Date of Patent: Nov. 21, 2023

(54) CIRCUIT BOARD WITH HIGH POWER INTERCONNECT CONDUCTIVE COIL

(71) Applicant: Hamilton Sundstrand Corporation, Charlotte, NC (US)

(72) Inventors: Nhia Yang, Roscoe, IL (US); Francis C. Belisle, Beloit, WI (US); Robert C. Cooney, Janesville, WI (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 12 days.

(21) Appl. No.: 17/539,427

(22) Filed: Dec. 1, 2021

(65) Prior Publication Data

US 2023/0170635 A1 Jun. 1, 2023

(51) Int. Cl.
*H01R 12/72* (2011.01)

(52) U.S. Cl.
CPC ..... *H01R 12/721* (2013.01)

(58) Field of Classification Search
CPC ..... H01R 12/721
USPC ..... 439/62
See application file for complete search history.

(56) References Cited

U.S. PATENT DOCUMENTS

| | | | | |
|---|---|---|---|---|
| 4,810,213 | A | 3/1989 | Chabot | |
| 4,969,824 | A | 11/1990 | Casciotti | |
| 5,722,845 | A | 3/1998 | Debortoli et al. | |
| 6,416,330 | B1 | 9/2002 | Yatskov et al. | |
| 6,472,599 | B2 | 10/2002 | Shepherd | |
| 7,727,013 | B1 * | 6/2010 | Paynter | H01R 9/0527 439/578 |
| 8,031,486 | B2 | 10/2011 | Wavering et al. | |
| 8,454,383 | B2 * | 6/2013 | Paynter | H01R 24/564 439/578 |
| 8,801,459 | B2 * | 8/2014 | Mrowka | H01R 24/50 439/246 |
| 9,225,083 | B2 * | 12/2015 | Krenceski | H01R 9/0521 |
| 9,293,849 | B2 * | 3/2016 | Balsells | H01R 13/03 |
| 10,622,771 | B2 | 4/2020 | Yang et al. | |
| 10,965,055 | B2 * | 3/2021 | Kompa | H01R 13/6271 |
| 2004/0224572 | A1 | 11/2004 | Hielscher et al. | |
| 2009/0149053 | A1 * | 6/2009 | Chansrivong | H01R 13/533 439/349 |

(Continued)

FOREIGN PATENT DOCUMENTS

| | | | |
|---|---|---|---|
| CN | 101330180 A | * | 12/2008 |
| DE | 102014101297 B4 | * | 6/2017 |

(Continued)

OTHER PUBLICATIONS

European Search Report for European Application No. 22210335.0, dated May 3, 2023, 11 pages.

*Primary Examiner* — Peter G Leigh
(74) *Attorney, Agent, or Firm* — CANTOR COLBURN LLP

(57) ABSTRACT

A connector for an electrical assembly includes an electrically conductive connector tab extending from a first electrical component, and a spring element wrapped around the connector tab. An electrically conductive connector slot is located at a second electrical component. The connector tab is configured for insertion into the connector slot such that the spring element is compressed between the connector tab and the connector slot defining an electrically conductive path between the connector tab and the connector slot.

16 Claims, 2 Drawing Sheets

(56) References Cited

U.S. PATENT DOCUMENTS

| | | | | |
|---|---|---|---|---|
| 2010/0112856 | A1* | 5/2010 | Paynter | H01R 9/0527 439/578 |
| 2010/0199493 | A1* | 8/2010 | Chansrivong | H01R 13/15 29/869 |
| 2012/0202378 | A1* | 8/2012 | Krenceski | H01R 13/5219 29/857 |
| 2015/0118899 | A1* | 4/2015 | Hugel | H01R 9/0515 439/578 |
| 2017/0373427 | A1* | 12/2017 | Kompa | H01R 13/17 |
| 2018/0076585 | A1 | 3/2018 | Harris, III et al. | |
| 2018/0135714 | A1* | 5/2018 | Kompa | F16F 1/13 |

FOREIGN PATENT DOCUMENTS

| | | | |
|---|---|---|---|
| EP | 2246940 | A1 | 11/2010 |
| EP | 2409364 | A1 | 1/2012 |
| EP | 3879635 | A1 | 9/2021 |
| EP | 3907829 | A1 | 11/2021 |
| JP | 2008204634 | A | 9/2008 |
| JP | 5872000 | B1 * | 3/2016 |
| WO | WO-2011088902 | A1 * | 7/2011 |
| WO | WO-2017178101 | A1 * | 10/2017 |

* cited by examiner

CIRCUIT BOARD WITH HIGH POWER INTERCONNECT CONDUCTIVE COIL

BACKGROUND

Exemplary embodiments pertain to the art of printed circuit boards, and in particular to connector configurations for high amperage printed circuit boards.

With new aerospace electrical power levels being above 400 amperes and wire feeders being specified in cross sectional area and not American Wire Gauge (AWG), Printed Circuit Board (PCB) mounted input and output connectors are becoming custom which drives up the cost of both aircraft and board mounted connectors. Currently, there is not a large variety of commercial connectors that offer high amperage and high voltage capabilities in a cost-effective package. Thus, typically, a custom connector is developed along with the supplier which requires supplier level qualification testing. Further, typical board mounted connectors take up a large area or volume on the printed circuit board, which reduces the area or volume available for placement of the electronic circuits.

High amperage printed circuit boards are made of copper inlay (embedded bus bar) or have surface copper bus bars, which are relatively thick, with soldered or press fit input/out connections. In manufacturing of the printed circuit board, larger input/out connector contacts require more heat to make electrical connections. The heat required to solder or weld the large contacts is then absorbed into the PCB and nearby electronic components, potentially reducing the board's reliability.

BRIEF DESCRIPTION

In one embodiment, a connector for an electrical assembly includes an electrically conductive connector tab extending from a first electrical component, and a spring element wrapped around the connector tab. An electrically conductive connector slot is located at a second electrical component. The connector tab is configured for insertion into the connector slot such that the spring element is compressed between the connector tab and the connector slot defining an electrically conductive path between the connector tab and the connector slot.

Additionally or alternatively, in this or other embodiments the spring element is a helical spring element.

Additionally or alternatively, in this or other embodiments a tab groove is formed in the connector tab in which the spring element is disposed.

Additionally or alternatively, in this or other embodiments the tab groove has a variable tab depth around a perimeter of the connector tab.

Additionally or alternatively, in this or other embodiments the connector tab is formed from one of a bus bar or copper inlay of the first component.

Additionally or alternatively, in this or other embodiments the spring element is formed from one of a copper or beryllium material.

Additionally or alternatively, in this or other embodiments the connector tab has a tapered end.

In another embodiment, an electrical component assembly includes a first electrical component having an electrically conductive element located therein, a second electrical component, and at least one connector assembly connecting the first electrical component. Each connector assembly includes an electrically conductive connector tab extending from the electrically conductive element of first electrical component and one or more spring elements wrapped around the connector tab. An electrically conductive connector slot is located at a second electrical component. The connector tab is configured for insertion into the connector slot such that the spring element is compressed between the connector tab and the connector slot defining an electrically conductive path between the connector tab and the connector slot.

Additionally or alternatively, in this or other embodiments the electrically conductive element is one of an electrically conductive inlay or a bus bar.

Additionally or alternatively, in this or other embodiments the spring element is a helical spring element.

Additionally or alternatively, in this or other embodiments a tab groove is formed in the connector tab in which the spring element is disposed.

Additionally or alternatively, in this or other embodiments the tab groove has a variable tab depth around a perimeter of the connector tab.

Additionally or alternatively, in this or other embodiments the spring element is formed from one of a copper or beryllium material.

Additionally or alternatively, in this or other embodiments the connector tab has a tapered end.

Additionally or alternatively, in this or other embodiments the first component is a solid state power controller.

Additionally or alternatively, in this or other embodiments the at least one connector assembly is two connector assemblies.

Additionally or alternatively, in this or other embodiments the one or more spring elements is two spring elements, each spring element disposed in a corresponding tab groove.

In yet another embodiment, a method of assembling two electrical components includes providing a first electrical component having an electrically element located thereat, and a connector tab extending from the electrically conductive element. One or more spring elements are wrapped around the connector tab. A second electrical component is provided, having an electrically conductive connector slot formed therein. The connector tab is installed into the connector slot, and the one or more spring elements are compressed between the connector tab and the connector slot, thereby defining an electrically conductive path between the first electrical component and the second electrical component.

Additionally or alternatively, in this or other embodiments each spring element is installed into a corresponding tab groove formed in the connector tab.

Additionally or alternatively, in this or other embodiments the electrically conductive element is one of an electrically conductive inlay or a bus bar.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
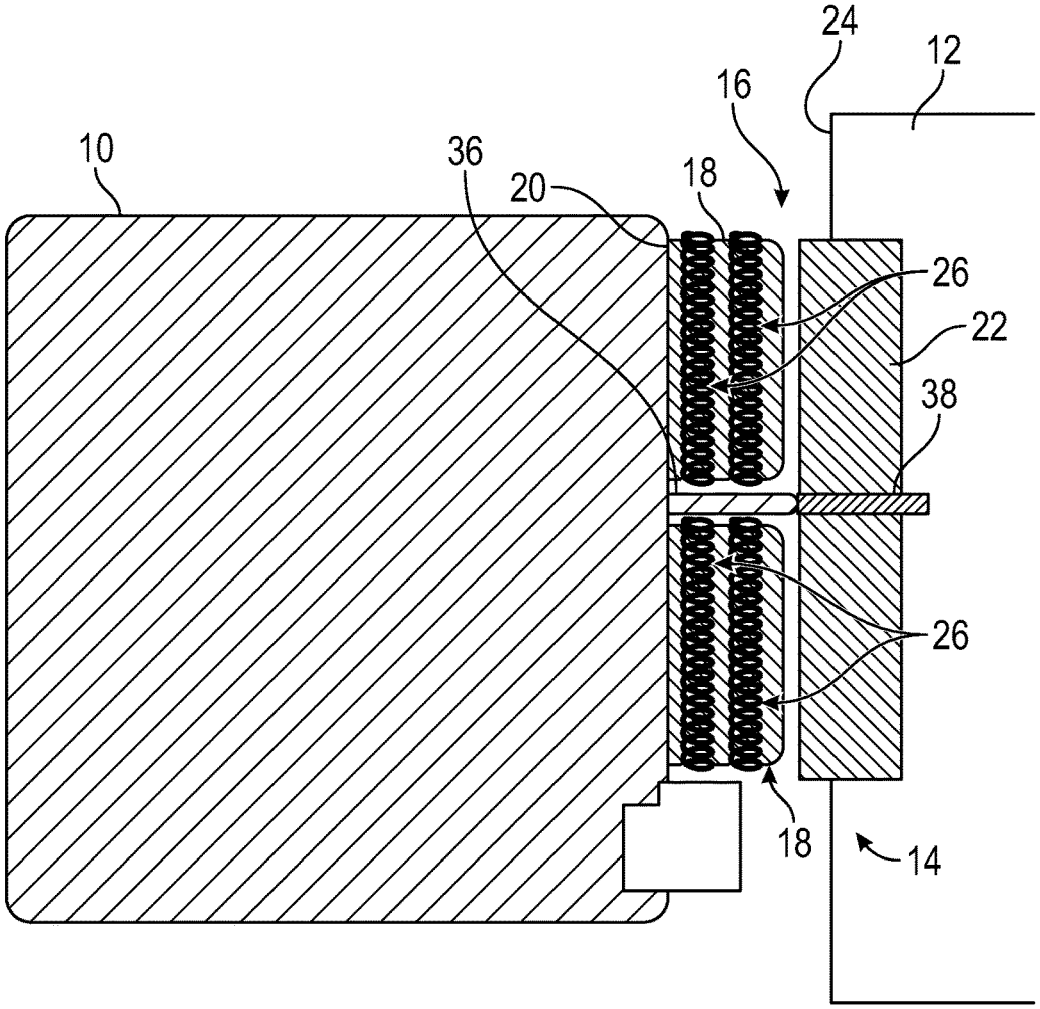
FIG. 1 is a plan view of an embodiment of a connector and slot configuration.

Referring to FIG. 1, illustrated is a connector configuration between a first component, for example, a solid state power controller (SSPC) 10, and a second component, such as a power distribution panel 12. One skilled in the art will readily appreciate that the connection configuration between the SSPC 10 and the panel 12 is merely exemplary, and that the connector configuration described herein and shown in the drawings may be applied between other first components and second components.

Figure 2:
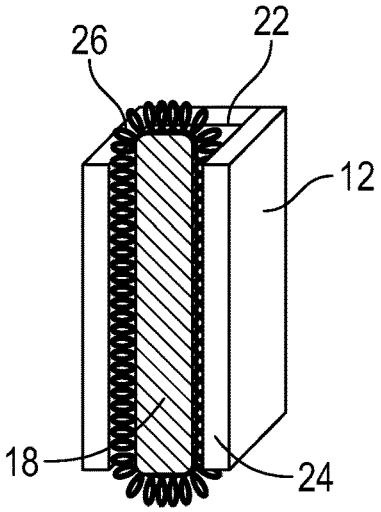
FIG. 2 is a perspective view of an embodiment of a connector tab installed into a connector slot.

The SSPC 10 is coupled to the panel 12 via an input connector 14 and an output connector 16. One skilled in the art will readily appreciate that a plurality of input connectors and output connectors, for multiple power busses or to connect higher power levels, may be applied similarly. Each of the input connector 14 and the output connector 16 includes a connector tab 18 formed at the SSPC 10 extending from an SSPC edge 20 extending around a perimetrical end of the SSPC 10. In some embodiments, the connector tab 18 is formed from a conductive element, such as a copper inlay or bus bar of the SSPC 10. The conductive element may be embedded in the SSPC 10 or alternatively may be surface mounted on the SSPC 10. The connector tab 18 is configured to be installed in a connector slot 22 of the panel 12, which is formed in a panel edge 24 extending around a perimetrical edge of the panel 12, as best shown in FIG. 2. While in the illustrated embodiment the connector tab 18 is located at the SSPC 10 and the connector slot 22 is located at the panel 12, one skilled in the art will readily appreciate that the configuration may be reversed such that the connector tab 18 is located at the panel 12 and the connector slot is located at the SSPC 10. To locate the connector tab 18 in the connector slot 22 and to electrically connect the connector tab 18 and the connector slot 22, a helical spring element 26 is wrapped around the connector tab 18 such that when the connector tab 18 is installed into the connector slot 22, the spring element 26 is between the connector tab 18 and the connector slot 22, and electrically connects the connector 18 and the connector slot 22. The spring element 26 is formed from an electrically conductive material, such as copper or a copper beryllium material, and may further be plated or otherwise coated to provide corrosion resistance. In some embodiments, the connector tab 18 has one spring element 26 installed thereto, while in the illustrated embodiment two spring elements 26 are installed to the connector tab 18 to increase the conduction area in high amperage applications. One skilled in the art will readily appreciate that additional spring elements may be added to further increase current carrying capacity of the connector(s).

Figure 3:
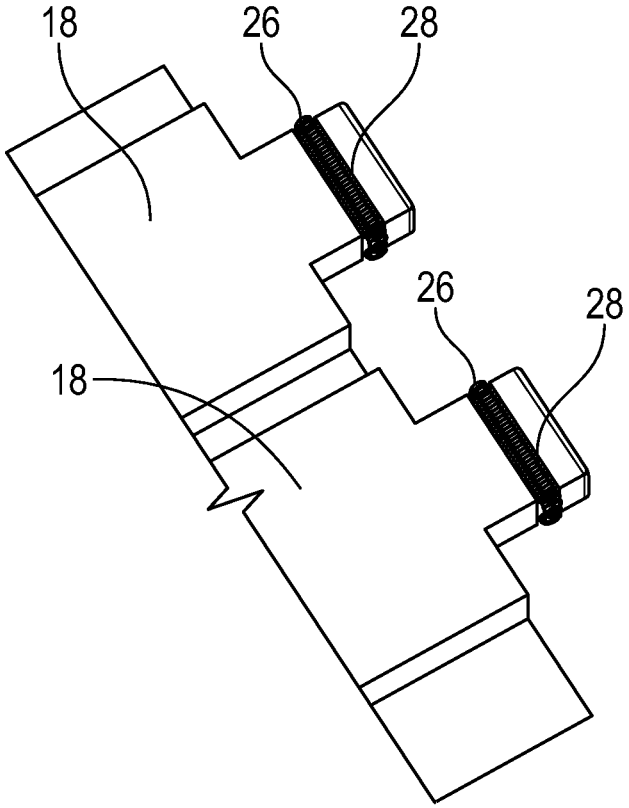
FIG. 3 is a perspective view of an embodiment of a connector tab having a spring element installed thereto.
Figure 4:
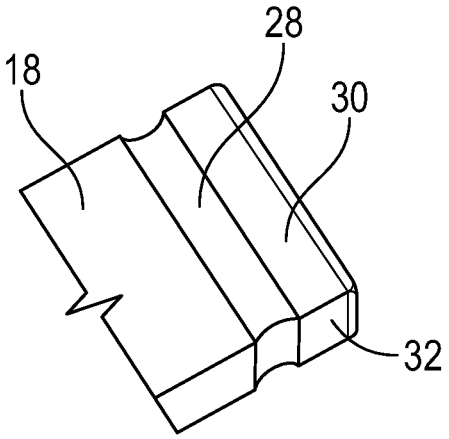
FIG. 4 is a view of an embodiment of a connector tab having a tab groove.
Figure 5:
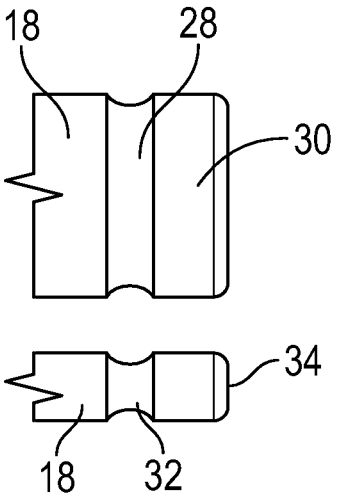
FIG. 5 is another view of an embodiment of a connector tab having a tab groove.

Referring now to FIG. 3, to retain the spring elements 26 on the connector tab 18, the connector tab 18 includes a corresponding tab groove 28 into which the spring element 26 is installed. The tab groove 28 is illustrated in more detail in FIGS. 4 and 5. The connector tab 18 has a rectangular cross-section with a long side 30 and a short side 32. The tab groove 28 has a first groove depth along the short side 32 which is greater than a second groove depth along the long side 30. Thus, the spring element 26 protrudes from the connector tab 18 more along the long side 30 than along the short side 32, such that the when the spring element 26 is installed in the tab groove 28 as shown in FIG. 3, the spring element 26 along the long side 30 of the connector tab 18 interfaces with the connector slot 22 to provide an electrically conductive path between the SSPC 10 and the panel 12, as shown in FIG. 2.

Referring again to FIG. 5, to aid in locating the connector tab 18 into the connector slot 22, in some embodiments a distal end 34 of the connector tab 18 is tapered. One or more other locating features may be utilized in installation of the connector tab 18 into the connector slot 22. For example, in some embodiments as shown in FIG. 1, a locating pin 36 extends from the SSPC edge 20 between the input connector 14 and the output connector 16, and is installed into a corresponding locating opening 38 in the panel edge 24.

In operation, once the connector tabs 18 are seated in their corresponding connector slots 22, the spring elements 26 are compressed and power is transferred between the SSPC 10 and the panel 12 via the connector slots 22 and the connector tabs 18 through the spring elements 26.

Utilizing the connector configurations disclosed herein allows for conduction of electrical power between the SSPC 10 and the panel 12 without the use of a board mounted connector, since the connector tabs 18 are formed integral with the copper inlay or bus bar of the SSPC 10, while the connector slots 22 are similarly formed in the copper inlay or bus bar of the panel 12 or a more traditional approach of an insulated connector mounted onto panel 12 with input and output cables with crimped lugs bolted onto the connector slots 22. Connector tabs 18 formed integral with the copper inlay or bus bar of the SSPC 10 eliminates soldering or welding of connectors which thus reduces heat absorbed into board, and therefore improves reliability of the board. Since the surface mounted connector is eliminated, this frees up space to fit more control circuits or eliminate the board space entirely which reduces the board overall dimensions. Use of the spring elements 26 increases the electrical conduction area which reduces the voltage drop and increases thermal conduction area. Further, use of the spring elements 26 eliminates the need for a floating connector to account for manufacturing tolerances. The compressed distance of the spring element 26 is considered the radial float which means the connector slot 22 can be rigidly mounted, and the spring element 26 absorbs any radial or linear positional error between the connector tab 18 and the connector slot 22. Installation of the spring elements 26 on the connector tabs 18 allows for easy inspection and/or replacement of the spring elements 26 in the case of wear or damage. The use of a spring element 26 eliminates the need for a secondary conductive element retention method. The spring is stretched during assembly. Once installed in the groove, the spring relaxes slightly. The spring is then retained by the remaining spring tension in the grove.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A connector for an electrical assembly, comprising:

an electrically conductive connector tab extending from a first electrical component;

a spring element wrapped around the connector tab; and an electrically conductive connector slot located at a second electrical component;

wherein the connector tab is configured for insertion into the connector slot such that the spring element is compressed between the connector tab and the connector slot defining an electrically conductive path between the connector tab and the connector slot;

a tab groove formed in the connector tab in which the spring element is disposed; and wherein the tab groove has a first groove depth at a first side of the connector tab and a second groove depth at a second side of the tab;

wherein the first groove depth is greater than the second groove depth.

2. The connector of claim 1, wherein the spring element is a helical spring element.

3. The connector of claim 1, wherein the connector tab is formed from one of a bus bar or copper inlay of the first component.

4. The connector of claim 1, wherein the spring element is formed from one of a copper or beryllium material.

5. The connector of claim 1, wherein the connector tab has a tapered end.

6. The connector of claim 1, further comprising a locating pin extending from the first electrical component adjacent to the connector tab and configured to be installed into locating opening in the second electrical component.

7. An electrical component assembly, comprising:

a first electrical component having an electrically conductive element disposed therein;

a second electrical component; and at least one connector assembly connecting the first electrical component, each connector assembly including:

an electrically conductive connector tab extending from the electrically conductive element of first electrical component;

one or more spring elements wrapped around the connector tab; and an electrically conductive connector slot located at the second electrical component;

wherein the connector tab is configured for insertion into the connector slot such that the spring element is compressed between the connector tab and the connector slot defining an electrically conductive path between the connector tab and the connector slot;

a tab groove formed in the connector tab in which the spring element is disposed; and wherein the tab groove has a first groove depth at a first side of the connector tab and a second groove depth at a second side of the tab;

wherein the first groove depth is greater than the second groove depth.

8. The assembly of claim 7, wherein the electrically conductive element is one of an electrically conductive inlay or a bus bar.

9. The assembly of claim 7, wherein the spring element is a helical spring element.

10. The assembly of claim 7, wherein the spring element is formed from one of a copper or beryllium material.

11. The assembly of claim 7, wherein the connector tab has a tapered end.

12. The assembly of claim 7, wherein the first component is a solid state power controller.

13. The assembly of claim 7, wherein the at least one connector assembly is two connector assemblies.

14. The assembly of claim 7, wherein the one or more spring elements is two spring elements, each spring element disposed in a corresponding tab groove.

15. A method of assembling two electrical components, comprising:

providing a first electrical component having an electrically element disposed thereat, and a connector tab extending from the electrically conductive element;

wrapping one or more spring elements around the connector tab;

providing a second electrical component having an electrically conductive connector slot formed therein;

installing the connector tab into the connector slot; and compressing the one or more spring elements between the connector tab and the connector slot, thereby defining an electrically conductive path between the first electrical component and the second electrical component;

wherein the one or more spring elements are disposed in one or more tab grooves formed in the connector tab; and wherein the tab groove has a first groove depth at a first side of the connector tab and a second groove depth at a second side of the tab;

wherein the first groove depth is greater than the second groove depth.

16. The method of claim 15, wherein the electrically conductive element is one of an electrically conductive inlay or a bus bar.

* * * * *